United States Patent [19]

Aamoth et al.

[11] 4,124,787

[45] Nov. 7, 1978

[54] JOYSTICK CONTROLLER MECHANISM OPERATING ONE OR PLURAL SWITCHES SEQUENTIALLY OR SIMULTANEOUSLY

[75] Inventors: Gerald R. Aamoth, Santa Clara; John K. Hayashi, San Mateo, both of Calif.

[73] Assignee: Atari, Inc., Sunnyvale, Calif.

[21] Appl. No.: 776,527

[22] Filed: Mar. 11, 1977

[51] Int. Cl.[2] ..... H01H 25/04

[52] U.S. Cl. ..... 200/6 A; 200/17 R; 200/153 K; 74/471 XY

[58] Field of Search ..... 200/5 A, 6 A, 17 R, 200/153 K; 74/471 XY

[56] References Cited

U.S. PATENT DOCUMENTS

| | | | |
|---|---|---|---|
| 3,005,055 | 10/1961 | Mattke | 200/6 A X |
| 3,033,946 | 8/1962 | Meyer et al. | 200/6 A |
| 3,277,248 | 10/1966 | Melvin, Jr. | 200/6 A |
| 3,856,998 | 12/1974 | Sims, Jr. | 200/5 A |
| 4,029,915 | 6/1977 | Ojima | 200/6 A X |

*Primary Examiner*—James R. Scott

*Attorney, Agent, or Firm*—Flehr, Hohbach, Test, Albritton & Herbert

[57] ABSTRACT

A joystick controller assembly for generating switch closures in response to X-Y manual movements includes an elongate lever arm or handle disposed to be tipped through an operating arc in any direction from the axis of the handle for closing switches. Individual springs coupled between the lower end portion of the handle move operating arms which press against and activate related switches carried on a printed circuit board for indicating the direction of movement of the handle.

5 Claims, 4 Drawing Figures

FIG_1
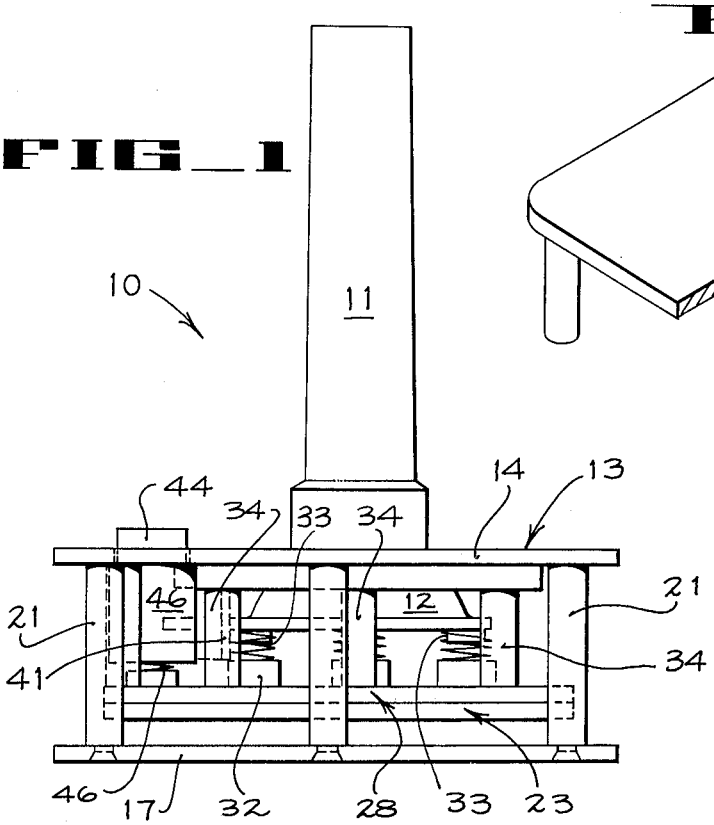
FIG_2
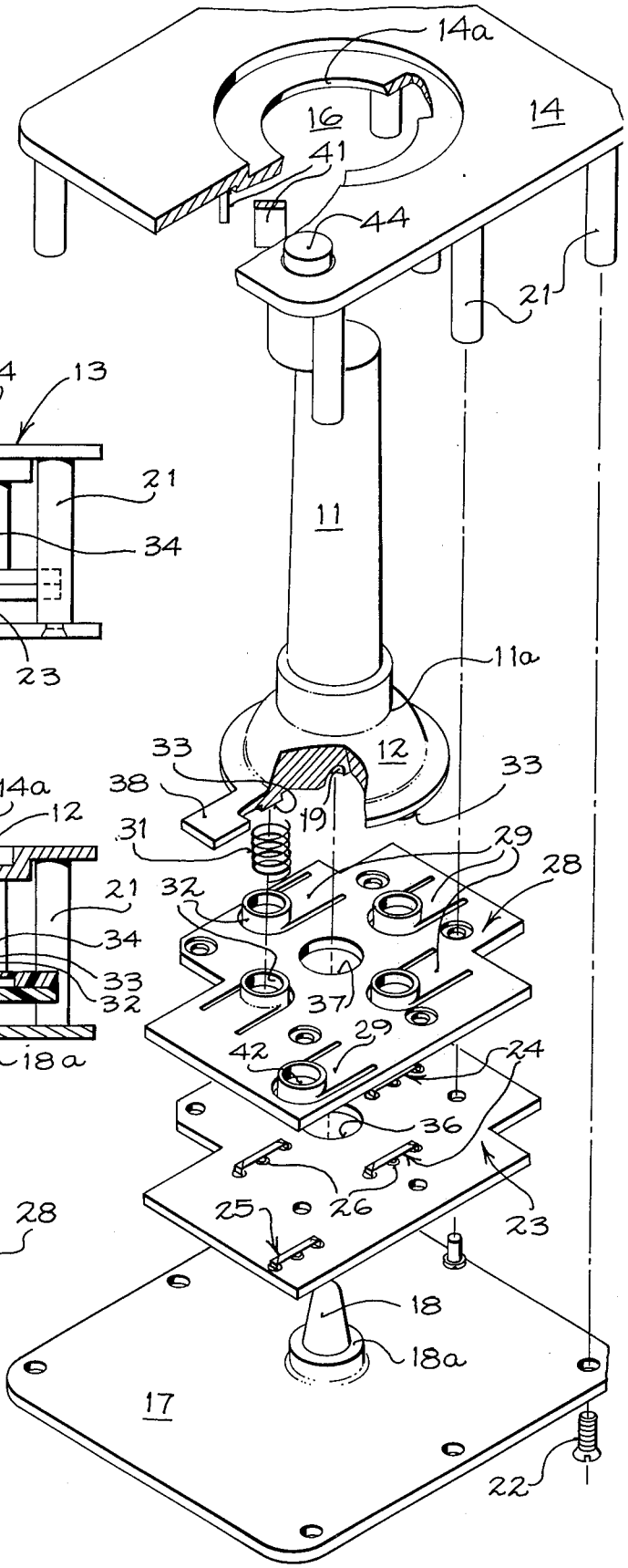
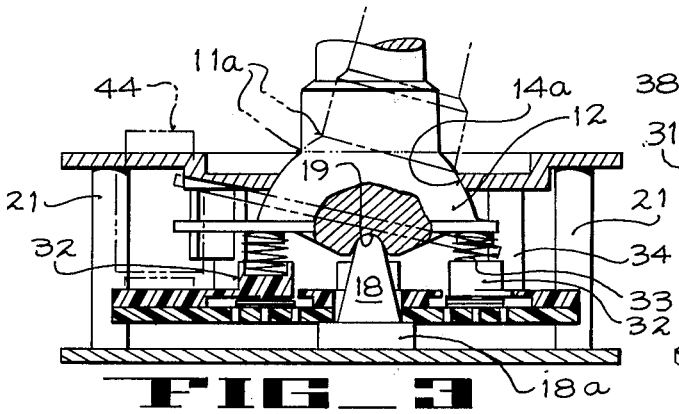
FIG_3
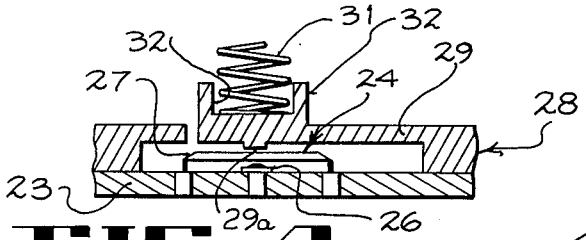
FIG_4

JOYSTICK CONTROLLER MECHANISM OPERATING ONE OR PLURAL SWITCHES SEQUENTIALLY OR SIMULTANEOUSLY

BACKGROUND OF THE INVENTION

This invention pertains to manually operated controller assemblies for generating switch closures in response to X-Y manual movements of a member, such as a joystick. This invention is particularly useful in conjunction with the manipulation of images on a video display.

Heretofore, so-called joysticks have been employed for purposes of generating switch closures including micro-switches and the like in order to achieve certain desired function. However it has been observed that the force required to actuate certain of these controls tends to become fatiguing to the operator and commensurately discourages continued play of coin-operated amusement machines, for example, or other similar devices whether for amusement, instruction or otherwise.

Accordingly, there is a need to provide an improved controller assembly which overcomes the foregoing and other problems as well as providing advantages of its own.

SUMMARY OF THE INVENTION AND OBJECTS

In general a controller assembly for generating switch closures in response to X-Y manual movements, employs an elongate handle or lever disposed upon pivot means which serves to axially support the handle for movement in an arc in directions radially of the axis of the handle. A substrate carries a plurality of pressure activated switches disposed in a predetermined pattern about the axis of the handle. An intermediate plate includes a plurality of operating arms to be disposed in a plane closely spaced from the plane of the substrate whereby each of the operating arms is movable into and out of pressure activating relation with respect to an associated one of said switches. Spring means carried by an end of the handle serve to transmit the operable force to the arms in response to movement of the handle in related directions for activating switches associated with the respective operating arms.

In general, it is an object of the present invention to provide an improved controller assembly of the kind described which allows a lesser activating force to be employed so as to minimize operator fatigue.

It is a further object of the present invention to provide a controller assembly in which means are provided for protecting against damage to the switches being closed by movement of the lever arm or handle.

The foregoing and other objects of the invention will become more readily evident from the following detailed description of a preferred embodiment when considered in conjunction with the drawings.

BRIEF DESCRIPTION OF THE DRAWINGS

FIG. 1 shows an elevation view of a joystick controller assembly according to the invention;

FIG. 2 shows an exploded perspective view partially broken away for clarity of the controller assembly shown in FIG. 1, according to the invention;

FIG. 3 shows an elevation section view of the lower end of the controller assembly as shown in FIG. 1; and FIG. 4 shows an enlarged elevation section view of a detail with respect to controlling switches of the assembly according to the invention.

DETAILED DESCRIPTION OF A PREFERRED EMBODIMENT

A controller assembly 10 of the so-called "joystick" style as herein disclosed comprises an elongate lever arm or handle 11 formed at its lower end with a dome-shaped bottom portion 12. The dome-shaped bottom portion 12 is disposed in a housing assembly 13 comprising a top or cover plate 14 characterized by an opening 16 disposed substantially centrally thereof and adapted to receive lever arm 11 therethrough.

A base plate 17 includes an upwardly extending pivot post 18. Pivot post 18 engages a detent 19 formed axially of lever arm 11 for supporting lever arm 11 to pivot thereon.

Spacer sleeves 21 or posts maintain cover plate 14 and base plate 17 in fixed spaced relation whereby an elongate bolt 22 can be fed upwardly therethrough and threadedly engage openings in cover plate 14.

A substrate such as the printed circuit board 23 carries a plurality of pressure activated switches 24 disposed in a predetermined pattern about the axis of lever arm 11.

Switches 24 comprise a pressure activated switch element 26 disposed beneath a flexible operator 27 formed and arranged to be pressed downwardly to snap against and operate the upwardly disposed switch element 26. The flexible operator pieces 27 have a top surface configuration corresponing somewhat to the shape of a hip roof of a house. As the top edge of the operator element 27 is engaged and pressed downwardly the side edges of element 27 expand slightly and then the intermediate portion snaps against the switch element 26 to operate it so long as the pressure is maintained.

An actuator plate 28 includes a plurality of operating arms 29 disposed in the plane of plate 28 and having a surface to be closely spaced to the plane of the substrate forming the circuit board 23. Each operating arm is movable into and out of pressure activating relation with respect to an associated one of the switch elements 26. Means for retaining elongate compressable coil springs 31 disposed between the underside of the dome-shaped bottom portion 12 and the top surface of operating arms 29 comprises the cylindrically shaped sockets 32 carried on the upper side of operating arms 29 and the downwardly depending bosses 33 carried on the underside of the dome-shaped bottom portion 12. Bosses 33 are disposed within the upper end of springs 31 while the lower ends of the springs 31 are disposed in the sockets 32.

Arms 29 include pressure portions **29*a* carried in confronting relation to and serving to operate an associated one of the flexible switch operators 27**.

Circuit board 23 and actuator plate 28 are maintained in adjacent planar relation by means of a plurality of downwardly depending supports 34. Printed circuit board 23 and actuator plate 28 each include a central opening 36, 37 respectively for receiving pivot post 18 extending upwardly therethrough.

The edge margin surrounding the underside of opening 36 rests upon the shoulder **18*a* of pivot post 18 so as to prevent the central portion of the printed circuit board 23 from sagging in response to application of force to switches 24. Such sagging of board 23, if not prevented, could require increased movement of arms 29** to effect operation of the switches which also might not be as reliable.

Means forming fixed stops for arresting movement of lever arm 11 in all directions prior to (fully) compressing springs 31 to the point where the convolutions engage and form a "hard" contact serves to prevent crushing the switch element 26. Thus, the inner edge 14*a* of top plate 14 surrounding opening 16 is disposed whereby portions of lever arm 11 engage the edge 14*a* of the opening before fully compressing the springs 31. Thus, as handle 11 is moved the surface portions 11*a* engage the inner edge 14*a* of opening 16 in the manner noted. In this manner some resilient connection will always be present between the underside of lever arm 11 and the top of switch element 26.

In addition to the engagement between the surface portions 11*a* of handle 11 with the edge 14*a* for arresting movement of handle 11 the undersurface of top plate 14 includes a portion 14*b* which is sloped at an angle on the order of 11° to the horizontal for engaging tab 38 as a secondary fixed stop which will not normally engage unless great force is applied to lever 11.

Means for limiting the degree of rotation of handle 11 about its axis serves to protect against twisting and dislodging of the springs 31 and includes the tab 38 extending radially outwardly from the lower edge of the dome-shaped bottom portion 12. Tab 38 fits between a pair of downwardly depending stop pins 41 to prevent rotation of handle 11 about its own axis.

Finally, it has been observed that preferred operation of apparatus of the kind described employs a separately disposed trigger switch (set apart from the handle) for firing a gun, for example, in a shooting game or the like. Accordingly, in the present instance there is shown a fifth switch 25 to be operated by the movement of arm 39 and socket 42 independently of the joystick operation.

From the foregoing it will be readily evident that there has been provided an improved controller assembly for generating switch closures in response to X-Y manual movements of a joystick.

As disclosed, there is interposed between the handle and the printed circuit board switches spring means and means for insuring the continued presence of a spring function between the joystick and the switches so as not to crush the switches in the operation of the joystick. Further, it should be noted that all of the operator arms are disposed to move in parallel planes whereby the manufacture of the actuator plate 28 can be readily made without rotating the plate 28 about an axis normal to the center thereof.

Finally, a firing button 44 disposed laterally of and separated from lever handle 11 is carried by top plate 14 in alignment with socket 42 for operating firing switch 25. A spring 46 transmits the movements of button 44 in the manner above described for springs 31 so as to protect against crushing the switch element of switch 25.

We claim:

1. A controller assembly for generating switch closures in response to X-Y manual movements, said assembly comprising an elongate handle, means supporting said handle for movement in an arc in directions radially of the axis of said handle, a substrate lying in a plane extending transversely of said axis, a plurality of pressure-activated switches carried on said substrate and disposed in a predetermined pattern about said axis, means disposing a plurality of operating arms in a plane closely spaced to the plane of said substrate, each of said operating arms being movable into and out of pressure activating relation with respect to an associated one of said switches, and means enabling said handle to be moved to apply a force selectively to one or more of said arms at a given time to selectively operate one or more of said switches singly or simultaneously, the last named means including spring means carried by a lower extension of said handle for transmitting an operable force to said arms in response to movement of said handle in related directions for activating switches associated with the last named said arms.

2. A controller assembly according to claim 1 comprising means forming fixed stops for arresting movement of said handle in all directions, said stops being disposed to arrest movement of said handle prior to fully compressing said spring means.

3. A controller assembly according to claim 2 in which said assembly includes a top plate formed with an opening for receiving said handle therethrough, portions of said handle being disposed with respect to the edge of said opening so as to engage said edge before said spring means can become fully compressed.

4. A controller assembly for generating switch closures in response to X-Y manual movements, said assembly comprising an elongate handle, means supporting said handle for movement in an arc in directions radially of the axis of said handle, a substrate lying in a plane extending transversly of said axis, a plurality of pressure-activated switches carried on said substrate and disposed in a predetermined pattern about said axis, means disposing a plurality of operating arms in a plane closely spaced to the plane of said substrate, each of said operating arms being movable into and out of pressure activating relation with respect to an associated one of said switches, and means enabling said handle to be moved to apply a force selectively to one or more of said arms at a given time to selectively operate one or more of said switches singly or simultaneously, the last named means including spring means carried by a lower extension of said handle for transmitting an operable force to said arms in response to movement of said handle in related directions for activating switches associated with the last named said arms, said spring means comprising a plurality of spirally wound extendable springs each coupled to an associated one of said arms, and means for limiting the degree of rotation of said handle about the axis thereof to protect against twisting said springs.

5. A controller assembly for generating switch closures in response to X-Y manual movements, said assembly comprising a base plate, pivot means carried by said base plate, a dome-shaped member supported on said pivot, a lever extending upwardly from said member for rocking said dome member on said pivot means, a substrate, a plurality of switches carried by said substrate in a predetermined pattern about the axis of said lever, each said switch being operable in response to application of pressure thereto, an actuator plate disposed adjacent said substrate, means carried by said plate for movement between advanced and retracted positions for applying said pressure to operate said switches, the last named means comprising operating arms yieldingly hinged at one end thereof to said plate and movable out of the plane of said plate, said arms including a pressure element carried in confronting relation to and operating an associated one of said switches, spring means extending between the other side of each of said arms and the underside of portions of said dome member, means disposed on said other side of the arms and said portions for engaging and retaining the opposite ends of said spring means for transmitting forces from said lever to said operating arms via said spring means, and means defining a fixed stop serving to arrest movement of said lever before fully compressing one of said springs.

* * * * *